United States Patent [19]

Ebeling

[11] Patent Number: 4,627,501

[45] Date of Patent: Dec. 9, 1986

[54] BORER HEAD WITH PLANETARY GEARING

[75] Inventor: Wolfgang Ebeling, Hanover, Fed. Rep. of Germany

[73] Assignee: Turmag-Turbo-Maschinen-Aktiengesellschaft Nuesse & Graefer, Sprockhoevel, Fed. Rep. of Germany

[21] Appl. No.: 704,291

[22] Filed: Feb. 22, 1985

[30] Foreign Application Priority Data

Feb. 25, 1984 [DE] Fed. Rep. of Germany ..... 3406855
Dec. 13, 1984 [DE] Fed. Rep. of Germany ..... 3445492

[51] Int. Cl.[4] ..... E21B 10/12; E21B 10/28

[52] U.S. Cl. ..... 175/319; 175/325; 175/331; 175/334; 175/344; 299/85

[58] Field of Search ..... 175/97, 98, 99, 106, 175/319, 325, 331, 334, 335, 344; 299/85, 86

[56] References Cited

U.S. PATENT DOCUMENTS

| | | | |
|---|---|---|---|
| 540,306 | 6/1895 | Fry | 175/106 |
| 1,333,491 | 3/1920 | Hughes | 175/319 |
| 2,850,272 | 9/1958 | Joy | 299/86 |
| 3,376,942 | 4/1968 | van Winkle | 175/99 |
| 3,387,892 | 6/1968 | Fischer et al. | 175/334 |
| 3,412,816 | 11/1968 | Lautsch | 299/86 |
| 3,477,762 | 11/1969 | Frenyo et al. | 299/86 |
| 3,729,057 | 4/1973 | Werner | 175/325 |
| 3,771,611 | 10/1973 | Omura | 175/348 |
| 3,945,445 | 3/1976 | Ikeda | 175/319 |
| 4,381,038 | 4/1983 | Sugden | 175/325 |

FOREIGN PATENT DOCUMENTS 3011449 10/1982 Fed. Rep. of Germany .

*Primary Examiner*—James A. Leppink
*Assistant Examiner*—Terry Lee Melins
*Attorney, Agent, or Firm*—Michael J. Striker

[57] ABSTRACT

In a borer head for drilling boreholes in rock structures and including a drive shaft connected to a drive of a drilling machine, a central shaft coupled to the drive shaft, and a tool holder with cutters driven by a planetary gearing connected to the central shaft, supporting elements, engageable with a cylindrical wall of the borehole being drilled, are provided. The supporting elements are operatively connected to the central shaft and also to the tool holder so that the tool holder is driven into a slow rotation about the central shaft.

27 Claims, 8 Drawing Figures

Fig. 3
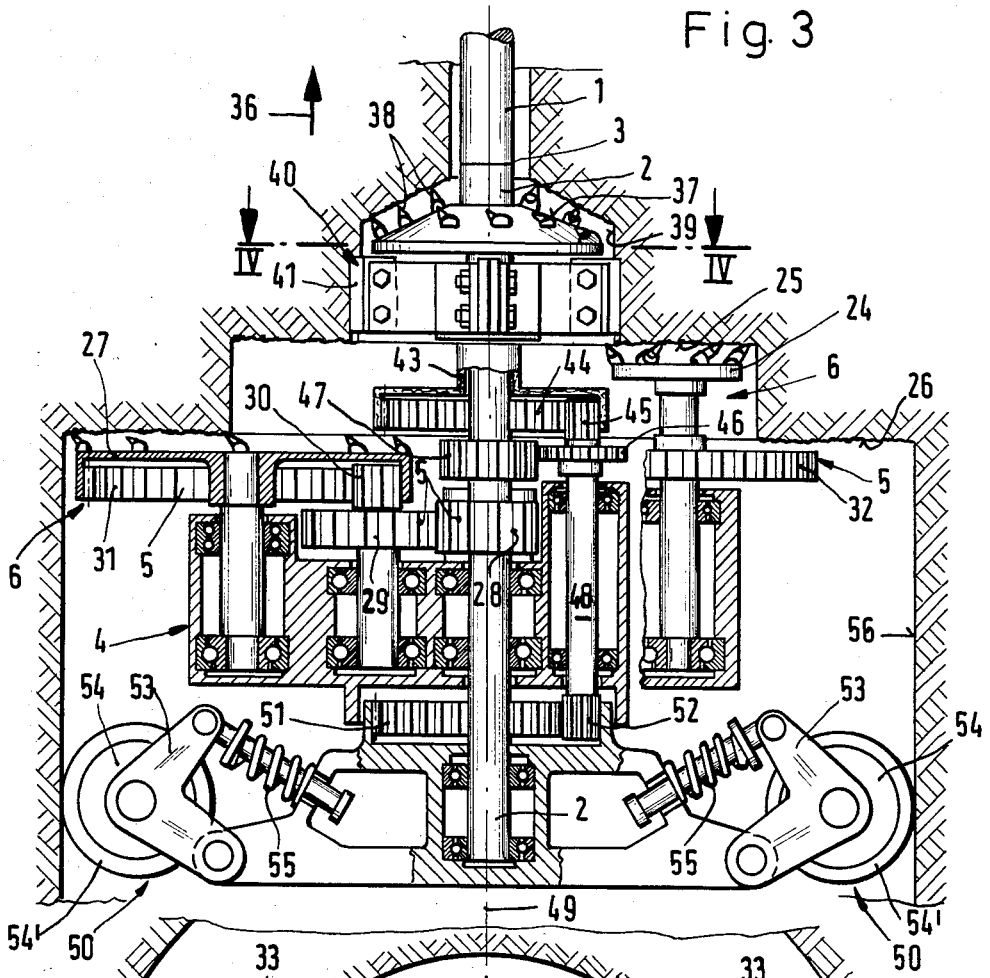
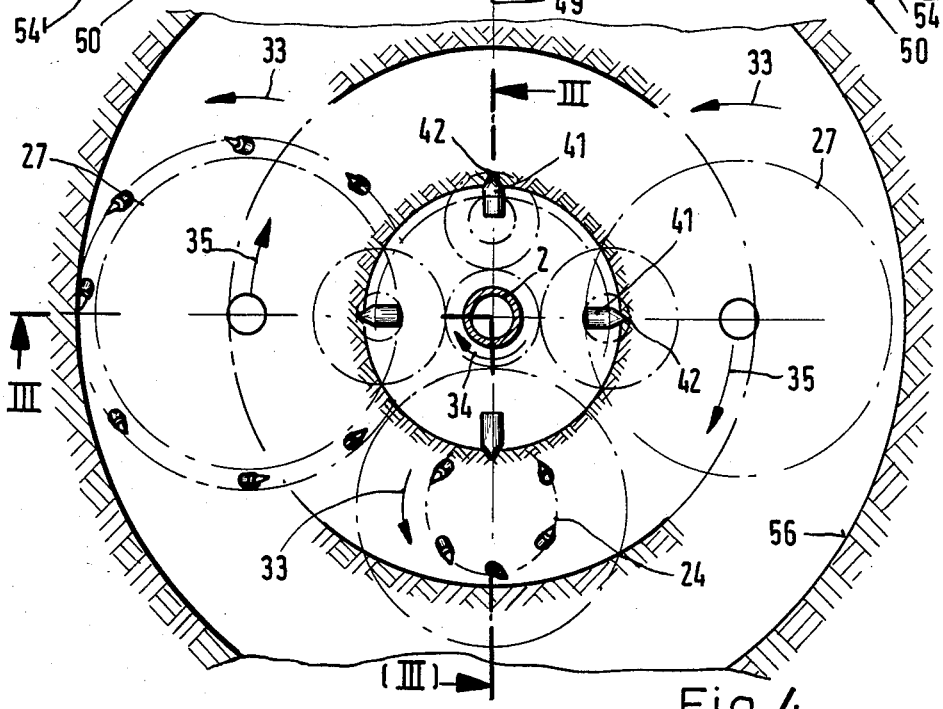
Fig. 4

Fig. 5
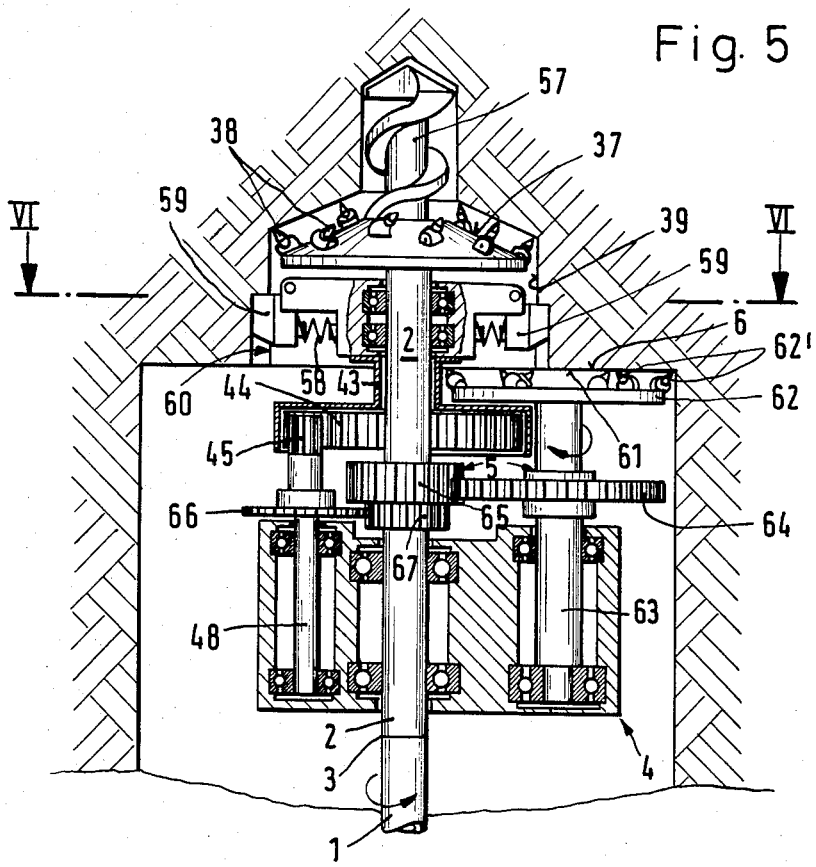
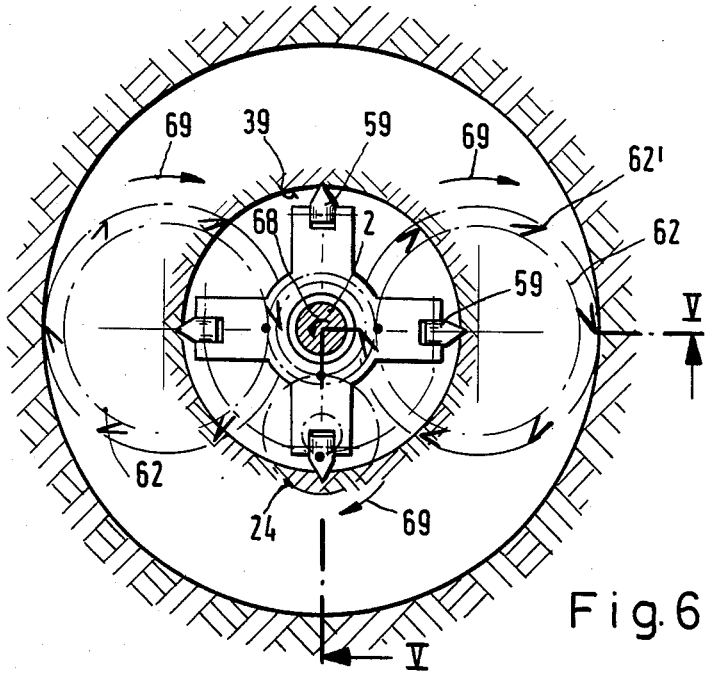
Fig. 6

BORER HEAD WITH PLANETARY GEARING

BACKGROUND OF THE INVENTION

The present invention relates to a borer head for drilling boreholes in rock structures.

The borer head of the type under consideration comprises a central shaft coupled to a simple driving shaft or rod and on which at least one tool holder, provided with cutters, is driven and rotated by means of a planetary gearing.

One of such borer heads is disclosed in the U.S. Pat. No. 3,771,611. In this conventional rock borer head the cutters are formed as cutting discs spaced from each other by angle 120°, the cutting discs being driven from the central shaft in a counter direction therewith and with reduced number of revolutions. The cutting discs operate in the direction of the drive torque, and for this purpose a drive translation between the central shaft and the driving shafts carrying the cutting discs is attained by a respectively formed planetary gearing. The borer head of such a construction must produce in the rock structure being drilled a respectively high cutting output. Then the cutting tool, due to a counter rotation of the shafts and due to a gear ratio with a highest torque, generates in the rock structure a reaction torque which assists in a revolving motion of the housing of the borer head about the central shaft. Thus this rotation moment assistance occurs, which sets the non-directly driven borer head housing in a required revolving motion. Thus the gear ratios, the number of the cutters on individual circular tracks of the cutting discs and the size of the circular surface of the borehole being drilled can be determined in dependence from each other.

Tests have surprisingly shown that the head borer of the conventional design can not ensure a satisfactory motion of the tool holder as well as satisfactory cutting speeds of the cutters. It has been determined that the tool holder can freely rotate with high number of revolutions and then turn about the central shaft with non-satisfactory rotation. This can be specifically observed from FIG. 2 of U.S. Pat. No. 3,771,611, in which the individual cutters in the proximity of the apex point of the involute track, lying on the wall of the borehole being drilled do not produce a cutting action but rather a rotational motion about themselves. Thus only a slowly and hardly removable step remains in the borehole, which significantly obstructs the feeding of the borer head. With the higher number of revolutions of the tool holder and with reduced drilling output it is impossible, however, to change the counter rotation of the whole borer tool relative to the central shaft.

SUMMARY OF THE INVENTION

It is an object of the present invention to provide an improved rock borer head.

It is another object of this invention to provide a device that would ensure a satisfactory revolving motion of the tool holder, and with which favorable cutting speeds and drilling output of the borer would be warranted.

These and other objects of the invention are attained by a borer head for drilling boreholes in rock structures, comprising a central shaft; a drive shaft coupled to the central shaft; at least one tool holder carrying cutters thereon; a planetary gearing operatively connecting said tool holder with said central shaft for driving and rotating said tool holder; and a supporting device operated to press against a cylindrical wall of a borehole being drilled and including a plurality of supporting elements radially symmetrically positioned on the supporting device in respect to said central shaft, said supporting device being operatively connected to said central shaft, on the one hand and to said tool holder, on the other hand, so that said tool holder is driven to a slow rotation about said central shaft.

Due to the provision of the supporting device a preliminary clamping of the borer head, driven from the central shaft, in a rock structure takes place whereby one or a number of tool holders carrying the cutters are forced into a rotational movement about the central shaft. Because of such a preliminary clamping with the rock structure and due to the forced rotational motion of the tool holder, various properties of the rock being drilled, various irregulatities of the cutters and a non-uniform engagement of the cutters with a hole wall no longer cause a free rotation of the tool holder about the central shaft. Thus a uniform and a uniformly-slow and satisfactory rotation motion of the tool holder about the central shaft and thus favorable cutting speeds and drilling output result.

Since the preliminary clamping of the supporting device in the rock structure takes place an undesired slipping-off effect in respective planes of the borehole can be avoided because this pre-clamping support can be identified as "static" support.

To provide for such "static" support the supporting elements may be elongated pads angularly spaced from each other and being oriented so that the direction of elongation of said pads is parallel to said central shaft.

The supporting elements may be rollers angularly spaced from each other and producing a rolling motion in a direction parallel to said central shaft.

The pads and rollers may be provided with cutting edges.

The supporting device may further include compression springs biasing said supporting elements against said cylindrical wall to bring said supporting elements into abutment with said wall.

The supporting elements may be caterpillar tracks spaced from each other by the same angle and pressible against said cylindrical wall and producing a caterpillar motion in a direction parallel to said central shaft.

Furthermore, the supporting elements may be hydraulically-operated clamping devices spaced from each other by the same angle and each provided with two piston-cylinder units, one of said piston-cylinder units including a clamping claw abutting against said cylindrical wall, the other of said units being a step-like operating hydraulic device having a longitudinal axis parallel to said central shaft.

The hydraulically-operated supporting device is disclosed, for example in DE-PS No. 3,011,449 (FIG. 3).

The caterpillar tracks and hydraulically-operated units may be provided with an energy source which would drive them in a feeding direction of the borer head whereby the drive shaft carrying a feeding drive would be unloaded.

The energy source may be positioned outside the borehole being drilled.

The energy source may be a hydraulic pump driven by said central shaft and secured to said supporting device.

The borer head may further comprise a pilot drill and an intermediate borer crown. The supporting device may be positioned in an axial direction of the borehole between said intermediate borer crown and a plane, through which said cutters are extended, said intermediate borer crown being engaged in a step of the borehole being drilled.

The supporting device may be positioned in an axial direction of the borehole being drilled behind a plane through which said cutters are extended, said supporting device being engaged in said cylindrical wall.

The planetary gearing may include at least one gear connected to said supporting device for joint rotation therewith and including an internal toothing, at least one pinion meshing with said internal toothing, a planetary shaft carrying said one pinion, at least one planetary gear on said planetary shaft, said central shaft carrying thereon a central pinion which meshes with said planetary gear which is driven from said central shaft.

Two tool holders may be provided, which are concentrically positioned on said central shaft, said tool holders having thereon roller cutters; the borer head may include a coupling for operatively connecting said drive shaft with said central shaft, said coupling having a curved, spherical toothing for effecting an angular displacement of said drive shaft relative to said central shaft, said central shaft having in the region of said coupling a straight-line internal toothing meshing with said spherical toothing and effecting an axial displacement of said drive shaft relative to said central shaft.

The borer head may further include a control device operative for setting said supporting device in a feeding direction when a predetermined axial displacement between said drive shaft and said central shaft is exceeded. At least one of said tool holders may be driven via said planetary gear in the same direction of rotation as that of said central shaft.

Independently from the "static" support a so-called "dynamic" support may be provided in the borer head of this invention. In such an embodiment cutter discs rotationally supported on the tool holder and having cutters are provided and the tool holder may include auxiliary supporting cutters connected thereto for joint rotation therewith, said first mentioned cutters being driven by said planetary gearing. The auxiliary cutters can be arranged on the tool holder in the axial direction of the borehole being drilled before, behind or in the same plane with the cutters on the cutter discs. The auxiliary cutters engage in the rock structure with a predetermined speed so that a circular cutting groove is formed in the rock. Inasmuch as the auxiliary cutters for a preliminary clamping of the tool holder in the rock structure, due to a rotational motion of the tool holder about the central shaft, do not remain at one place but uniformly rotate about the central shaft such a preliminary clamping support can be identified as a "dynamic" support.

The auxiliary cutters may be positioned at a predetermined radius from an axis of said central shaft, said radius being greater than the greatest distance of the cutters on the cutter discs from the central shaft. Thus the free rotation of the tool holder with a high number of revolutions no longer takes place, and a favorable involute track of the cutters is ensured due to the present invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 3 is a sectional view taken on line III—III of FIG. 4 and showing a second embodiment including a "static" support of the borer head, having a concentrical intermediate borer crown, a supporting device positioned in an intermediate borehole, and cutting discs disposed in two planes;

FIG. 4 is a sectional view taken along line IV—IV of FIG. 3;

FIG. 5 is a sectional view taken along line V—V of FIG. 6 and showing yet another embodiment of the "static" support of the borer head provided with a pilot borer and with a plurality of elastically supported pressing pads;

FIG. 6 is a sectional view taken along line VI—VI of FIG. 5;

DETAILED DESCRIPTION OF THE PREFERRED EMBODIMENTS

Figure 1:
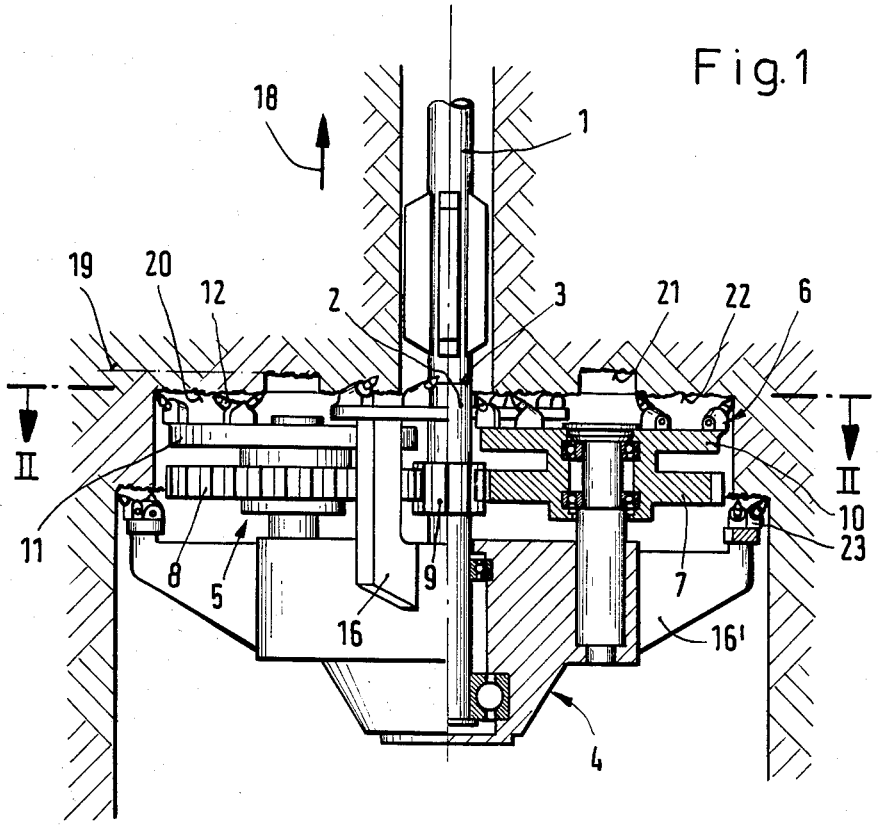
FIG. 1 is an axial view, partially in section, of a first embodiment including a "dynamic" support of the borer head of this invention, during the "raise-boring"

Referring now to the drawings in detail, reference numeral 1 in all the figures designates a borer drive shaft which is normally connected to a non-shown drive, reference numeral 2 denotes a central shaft of the borer head, and reference numeral 3 designates a schematically shown and conventional coupling between the drive shaft 1 and central shaft 2.

The borer head of each embodiment further includes a tool holder 4 rotationally supported about the central shaft 2 and carrying a planetary gearing 5, by means of which cutters 6 are driven and rotatable.

Figure 2:
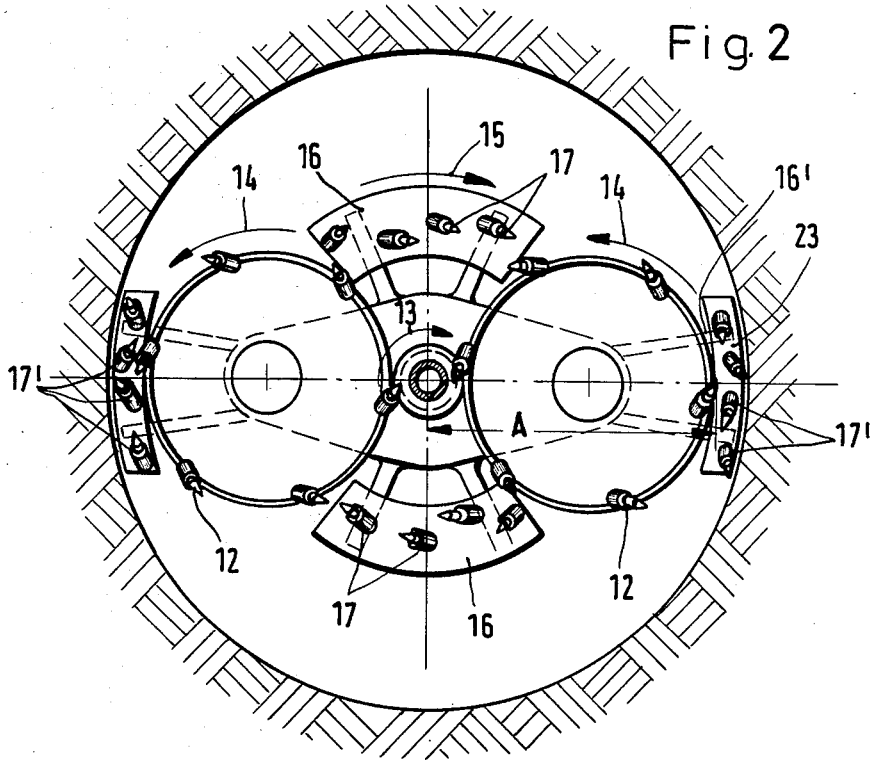
FIG. 2 is a top plan view taken from line II—II of FIG. 1.

Referring now to FIGS. 1 and 2 in greater detail, these figures illustrate a "dynamic" support of the borer head. The borer head of this embodiment further includes two planetary gears 7 and 8 which are in mesh with and driven by a pinion 9 which is mounted to the central shaft 2 for joint rotation therewith. At the same time cutting discs 10 and 11 are immediately connected to the respective planetary gears 7 and 8. In the exemplified embodiment planetary gears 7 and 8 are formed in one piece with respective cutting discs 10 and 11. Thus cutting discs 10 and 11, provided with bits 12, are set in rotation by the rotation of the planetary gears 7, 8. The planetary gears 7, 8 and thereby the cutting discs 10, 11 are rotated in the direction of arrows 14 when the drive shaft 1 and central shaft 2 therewith rotate in the direction of arrow 13, as clearly seen from FIG. 2. Inasmuch as the tool holder 4 is rotationally positioned on the central shaft 2 due to a bearing arrangement, the tool holder 4 turns in the direction of arrow 15. In order to slow down an undesired fast revolving movement of tool holder 4 in the direction of arrow 15 and also the movement of cutting discs 10, 11 in the direction of arrows 14 counter to the direction of rotation of the drive shaft or rod and central shaft 2, cantillevers or holders 16, carrying auxiliary cutters or bits 17 are arranged on the tool holder 4. Cantilevers 16 are positioned in the inward direction of the borehole being drilled, that is in the direction of arrow 18, in plane 19 which is disposed in the direction of arrow 18 before plane 20 at which the ends of the bits of the cutting discs 10, 11 are located. Thereby auxiliary cutters 17, upon the revolving movement of the tool holder 4, ditch into the rock structure in the direction of arrow 15 and thus make in the surface 22 of the rock a circular groove 21.

Advantageously, additional holders 16' can be provided, equipped with auxiliary cutters 17' and positioned radially symmetrically in respect to central shaft 2 as shown in FIG. 2. Holders or cantilevers 16' are connected to the tool holder 4 to be turned thereby.

A specifically advantageous action is performed by auxiliary cutters 17' when they are arranged on a radius 23 which is insignificantly greater than the greatest possible distance "A" from the axis of central shaft 2, at which distance cutters 12 of discs 10, 11 are distributed, as shown in FIG. 2.

With reference to FIGS. 3 and 4 it will be seen that these figures illustrate a so-called "static support" of the borer head. In this embodiment a first cutting disc 24 of a drill or borer 6 is positioned in a first plane 25 while two further cutting discs 27, operated for drilling greater borehole diameters, are positioned in a second plane 26. All cutting discs 24 and 27 are driven by planetary gears 29, 30, 31, 32 from a pinion 28 on the central shaft 2 to rotate in the direction of arrows 33, which is counter to the direction of rotation 34 of central shaft 2 and thus drive rod 1. The tool holder 4 therefore turns in the direction of arrow 35 according to FIG. 4.

An intermediate borer cutting crown 37, which is mounted immediately on central shaft 2 for joint rotation therewith, is positioned in the direction 36 of the borehole being drilled, before the cutting discs 24, 27. The intermediate cutting crown has cutting bits 38 for drilling an intermediate borehole 39. Behind the intermediate cutting crown 37 is a first "static" supporting device 40. This supporting device is provided with rigidly mounted pressing or cutting pads 41, the cutting edges 42 of which cut into the wall of the intermediate borehole 39. Supporting device 40 is connected with a hollow gear 44 via a hollow shaft 43. Hollow gear 44 has an internal toothing which is in mesh with a pinion 45 of an additional planetary gearing including planetary gears 46, 47. A planetary shaft 48 carrying thereon gear 46 is driven via the gear 46 from a further pinion 47 rigidly mounted on central shaft 2. The planetary gearing 46, 47, 48 in cooperation with the supporting device 40, the hollow shaft 43, hollow gear 44 and pinion 45 forces the tool holder 4 in a slow rotation about a central axis 49.

Below the tool holder 4, a second "static" supporting device 50 is mounted on the central shaft 2. The second supporting device 50 includes a hollow gear 51 having an internal toothing which is in mesh with a planetary pinion 52 secured to the planetary shaft 48. The drive transmission and the direction of rotation from the planetary shaft 48 via pinion 52 to the hollow gear 44 are the same as the corresponding transmission and the direction of rotation of the upper pinion 45 relative to the hollow gear 44. The second supporting device also has rollers 54 positioned on rocking members or levers 53. Rollers 54 located at two opposite sides of the central shaft are biased by compression springs 55 against the wall of the bore 56 of the greatest diameter. Rollers 54 can be provided with cutting edges 54' on their peripheries.

FIGS. 5 and 6 illustrate still another embodiment of the invention with a "static" support of the borer head. In this embodiment the borer head, driven from the drive shaft 1, is provided with a pilot drill 57 and a supporting device 60 which includes a plurality of cutting or pressing pads 59 which operate under the action of compression springs 58.

Immediately behind the pilot drill 57 is arranged on the central shaft 2 an intermediate cutting or drilling crown 37 provided with cutting bits for drilling an intermediate borehole 39. The drilling tool 6 in this embodiment, in contrast to the embodiment of FIGS. 3 and 4, has two cutting discs 62 positioned in the same plane 61. Cutting discs 62 are, via a shaft 63, rotationally supported by bearings in the tool holder 4, and a planetary gear 64, rigidly mounted on shaft 63, is driven from the pinion 65 mounted on central shaft 2 for joint rotation therewith.

The supporting device 60 is operatively connected, via the hollow shaft 43 and hollow gear 44 engaged with planetary pinion 45, with the planetary shaft 48. A further planetary gear 66 is arranged on shaft 48 for joint rotation therewith. Gear 66 is driven from a further pinion 67 also rigidly mounted on central shaft 2. In case the central shaft 2 rotates in the direction of arrow 68 this rotation causes cutting discs 62 to rotate in the direction of arrow 69.

Figure 7:
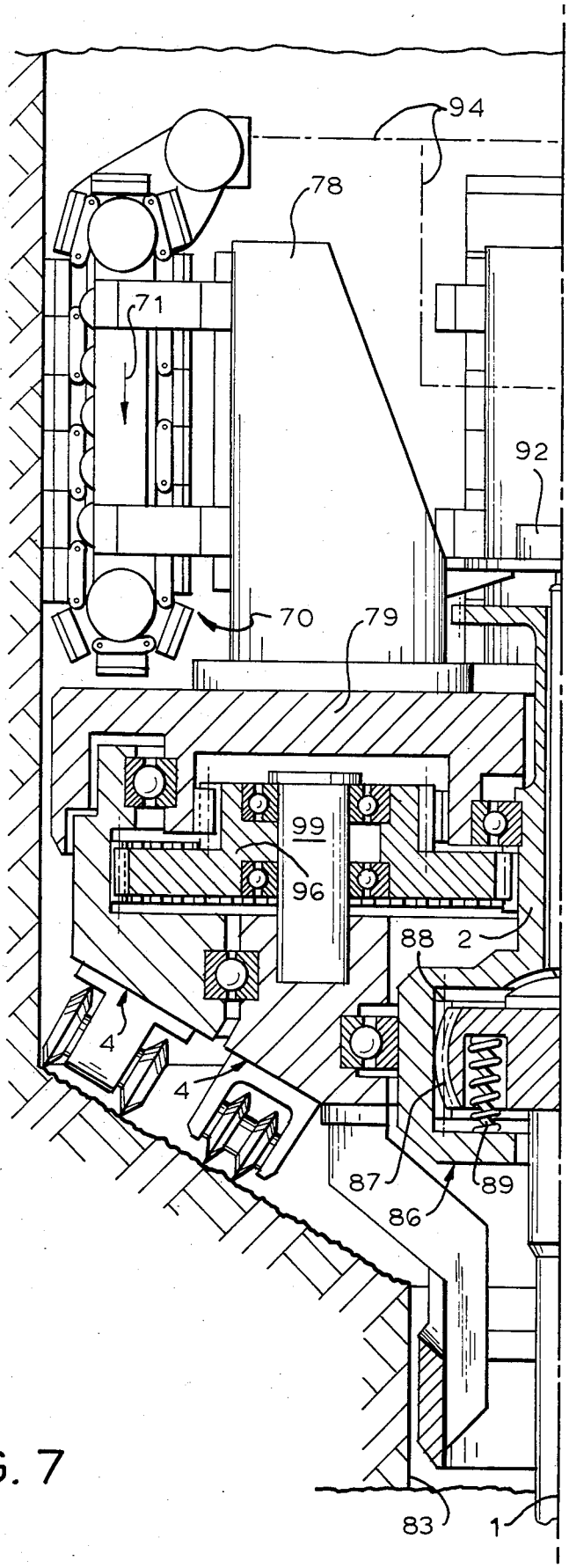
FIG. 7 is an axial view, partially in section, of a further embodiment of a "static" support, in which the borer head is provided with an enlarging borer head equipped with roller cutters on two concentrically positioned tool holders.

FIG. 7 illustrates a third modified embodiment of the "static" support of the borer head. In this embodiment the supporting device includes a plurality of caterpillar tracks 70 which are urged against the borehole wall 56 and which are distributed over the periphery of the supporting device such that they are spaced from each other by the same angle. The caterpillar motion of tracks 70 in the direction of arrow 71 parallel to the central shaft 2 concides with that of the axis of rotation 49.

Figure 8:
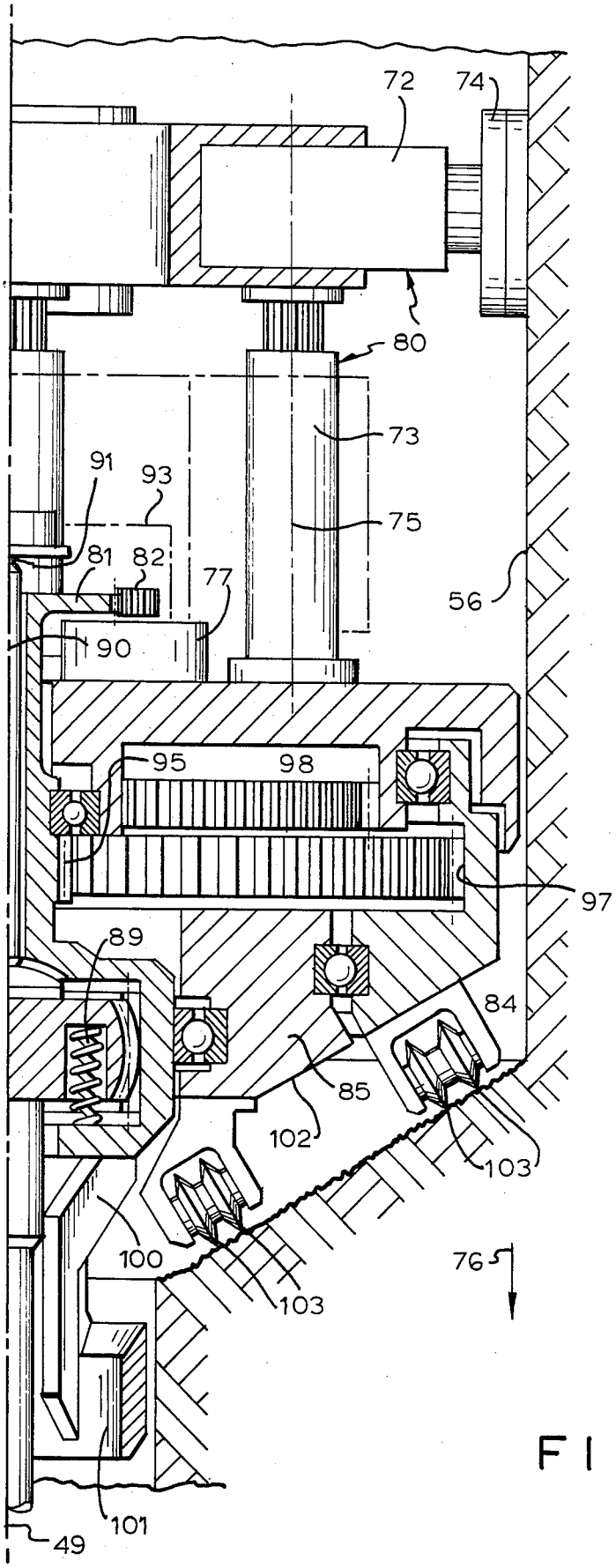
FIG. 8 is an axial view, partially in section, of still further embodiment of a "static" support of the borer head including four hydraulically-operated step devices with four clamping claws supported against the wall of the borehole being drilled.

The fourth embodiment of the "static" support of the borer head is shown in FIG. 8. In the embodiment of FIG. 8 the head borer includes a plurality of hydraulically-operated clamping devices 80 offset from each other by the same angle in the known fashion. Each clamping device includes two piston-cylinder units 72 and 73, of which piston-cylinder unit 72 has a clamping claw 74 which presses against the borehole wall 56, and another piston-cylinder unit 73 is constructed as a step-operating device which has a central axis 75 parallel to the rotation axis 49 of central shaft 2. Caterpillar tracks 70 of the embodiment of FIG. 7 and piston-cylinder units 80 of the embodiment of FIG. 8 can be provided with an energy supply source for driving them in the feeding direction designated by arrow 76. This energy source can include a hydraulic pump 77 (FIG. 8) which can be positioned outside or inside of the borehole 56. The hydraulic pump 77 will be then secured to a supporting plate 79 connected either to one of cantilevers 78 also connected to the caterpillar tracks 70 (FIG. 7) and/or to the piston-cylinder units 80 (FIG. 8). In both embodiments, central shaft 2 extends through the supporting plate 79 for free rotation therein. The hydraulic pump 77 is driven by a gear 81 positioned at the upper end of central shaft 2 and a driving pinion 88.

In both embodiments of FIGS. 7 and 8 the borer head ascends along the borehole 83 and cuts in the hard rock structure. The borer head in both embodiments is provided with roller-type cutters 103 which are respectively secured to two tool holders 84, 85 concentrically positioned on the central shaft 2. The drive shaft 1 is coupled to central shaft 2 by a coupling 86. An angular displacement between the drive shaft 1 and the central shaft 2 can be obtained by a spherically-extended cupola-shaped toothing 87 in coupling 86 whereas a longitudinal displacement between shaft 1 and shaft 2 can be obtained by means of the straight-line toothing 88 on the central shaft 2. A plurality of compression springs 89 provided in coupling 86 of the embodiment of FIG. 7 or FIG. 8 act against the traction of drive shaft 1. The axial or longitudinal displacement of the spherical toothing 87 relative to the straight-line toothing 88 of the central shaft 2 is transmitted, via a control rod 90, to a sensor 91 of a controlling device 92. The controlling device 92, via a controlling conduit 93 (FIG. 8) sets in operation the hydraulic pump 77 which moves either caterpillar tracks 70 in the direction of arrow 71, via hydraulic conduits 94, or the step-like operating unit comprised of piston-cylinder units 80 for moving cylinders 73 in the direction of arrow 76. Thus the roller cutters 103 are pressed against the rock structure and the drive shaft 1 is simultaneously unloaded.

At the same time central shaft 2 slowly drives the outer tool holder 84 in the direction counter to that of drive shaft 1 via a pinion 95 meshed with a double planetary gear 96, which is meshed with an internal toothing 97 of the tool holder 84. The double planetary gear 96 is at the same time in mesh with an internal toothing 98 of the supporting plate 79 of the supporting device and causes, via a planetary axle 99 (shown only in FIG. 7), the inner tool holder 85 to rotate somewhat faster and in the same direction with the drive shaft 1.

A guiding cage 100 is connected to the inner tool holder 85. This guiding cage ensures with its ring 101 a guidance and centering of the borer head in a preliminary borehole 83.

In the embodiments of FIGS. 7 and 8 two tool holders 84 and 85, concentrically positioned on a hollow central shaft 2, are incorporated one in another. One tool holder, namely outer tool holder 84 is driven via planetary gears 95, 96, 97 in the direction of rotation of the central, shaft 2 and counter to the direction of rotation of drive shaft 1.

It is to be understood that various structural combinations are possible within the limits of the present invention. For example, a "dynamic" support according to FIGS. 1 and 2 can be combined with a "static" support according to FIGS. 3 to 6. The supporting devices 70 and 80 of FIGS. 7 and 8 can be utilized in place of the supporting device 50 of FIGS. 3 and 4.

Finally, it is possible to use a "dynamic" support of FIGS. 1 and 2 in the embodiment of FIG. 7 or 8 so that the counter rotation of two tool holders 84 and 85 would lead to the construction with static supporting devices 70 or 80 for maintaining a rest torque. The torque-compensation for the embodiment of FIGS. 1 and 2 can be obtained by use of the borer head of FIGS. 7 and 8 by means of a corresponding selection of dimensions of tool holders 84 and 85, by a selection of opposite gear ratios and by provision of the tool holders 84, 85 with cutters of FIGS. 1 and 2 so that the "static" support 70 or 80 can be omitted. In this case the drilling pressure is applied to the rock by the weight of the borer head and the pulling force of the drive shaft 1.

It will be understood that each of the elements described above, or two or more together, may also find a useful application in other types of borer heads with planetary gearings differing from the types described above.

While the invention has been illustrated and described as embodied in a borer head with a planetary gearing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A borer head for drilling boreholes in rock structures, comprising a central shaft (2); a single drill pipe (1) coupled to the central shaft; at least one tool holder (4) carrying cutters thereon; a planetary gearing (28, 29, 30, 31, 32) driving, coupling and rotating said tool holder with said central shaft; and a supporting device (40) operated to press against a cylindrical wall of a borehole being drilled and including a plurality of supporting elements (41, 54, 59, 74) radially symmetrically positioned on the supporting device in respect to said central shaft, said supporting device being coupled by a gearing (44, 45, 46, 47) to said central shaft, on the one hand, and to said tool holder, on the other hand, so that said tool holder is driven to a slow rotation about said central shaft.

2. The borer head as defined in claim 1, wherein said supporting elements are elongated pads (41, 59) angularly spaced from each other and being oriented so that the direction of elongation of said pads is parallel to said central shaft.

3. The borer head as defined in claim 1, wherein said supporting elements are rollers (54) angularly spaced from each other and producing a rolling motion in a direction parallel to said central shaft.

4. The borer head as defined in claim 2, wherein said pads are provided with cutting edges.

5. The borer head as defined in claim 3, wherein said rollers are provided with cutting edges.

6. The borer head as defined in claim 1; said supporting device further including compression springs (58, 55) biasing said supporting elements against said cylinderical wall to bring said supporting elements into abutment with said wall.

7. The borer head as defined in claim 1, wherein said supporting elements are caterpillar tracks (70) spaced from each other by the same angle and pressable against said cylindrical wall and producing a caterpillar motion in a direction parallel to said central shaft.

8. The borer head as defined in claim 1, wherein said supporting elements are hydraulically-operated clamping devices spaced from each other by the same angle and each provided with two piston-cylinder units, one of said piston-cylinder units including a clamping claw abutting against said cylindrical wall, the other of said units being a step-like operating hydraulic device having a longitudinal axis parallel to said central shaft.

9. The borer head as defined in claim 7, further including an energy source for driving said caterpillar tracks in a feeding direction of the borer head.

10. The borer head as defined in claim 8, further including an energy source for driving said clamping devices in a feeding direction of the borer head.

11. The borer head as defined in claim 10, wherein said energy source is positioned outside the borehole being drilled.

12. The borer head as defined in claim 9, wherein said energy source is a hydraulic pump driven by said central shaft and secured to said supporting device.

13. The borer head as defined in claim 10, wherein said energy source is a hydraulic pump driven by said central shaft and secured to said supporting device.

14. The borer head as defined in claim 1; further comprising a pilot drill (57) and an intermediate borer crown (37).

15. The borer head as defined in claim 14, wherein said supporting device (40) is positioned in an axial direction of the borehole between said intermediate borer crown and a plane, through which said cutters are extended, said intermediate borer crown being engaged in a step of the borehole being drilled.

16. The borer head as defined in claim 14, wherein said supporting device (50) is positioned in an axial direction of the borehole being drilled behind a plane, through which said cutters are extended, said supporting device being engaged in said cylindrical wall.

17. The borer head as defined in claim 14, wherein said supporting device includes a first supporting arrangement (40) which is positioned in an axial direction of the borehole between said intermediate borer crown and a plane through which said cutters are extended, and a second supporting arrangement (50) which is positioned in said axial direction behind said plane.

18. The borer head as defined in claim 1, wherein said planetary gearing includes at least one gear (44) connected to said supporting device (40, 60) for joint rotation therewith and including an internal toothing, at least one pinion (45) meshing with said internal toothing, a planetary shaft (48) carrying said pinion, at least one planetary gear (46, 66) on said planetary shaft, said central shaft carrying thereon a central pinion (47, 67) which meshes with said planetary gear which is driven from said central shaft.

19. The borer head as defined in claim 1, wherein two tool holders (84, 85) are provided, which are concentrically positioned on said central shaft said tool holders having thereon roller cutters (103); and further including a coupling (86) for operatively connecting said drive shaft with said central shaft, said coupling having a curved spherical toothing for effecting an angular displacement of said drive shaft (1) relative to said central shaft, said central shaft having in the region of said coupling a straight-line internal toothing meshing with said spherical toothing and effecting an axial displacement of said drive shaft relative to said central shaft.

20. The borer head as defined in claim 19, further including a control device (90, 91, 92) operative for setting said supporting device (70, 80) in a feeding direction when a predetermined axial displacement between said drill pipe and said central shaft is exceeded.

21. The borer head as defined in claim 20, wherein at least one of said tool holders (84) is driven via said planetary gearing in the same direction of rotation as that of said central shaft.

22. A borer head for drilling boreholes in rock structures, comprising a central shaft (2); a single drill pipe (1) coupled to said central shaft; at least one tool holder 4; cutter disc (10, 11) rotationally supported on said tool holder and having cutters (12); and a planetary gearing (7, 8, 9) driving and rotating said tool holder relative to said central shaft, said tool holder (4) including auxiliary supporting cutters (17, 17') connected thereto for joint rotation therewith, said first mentioned cutters (12) being driven by said planetary gearing, said auxiliary cutter being radially symmetrically positioned in respect to said central shaft to press against a wall of a borehole being drilled whereby said tool holder is driven to a slow rotation about said central shaft.

23. The borer head as defined in claim 22, wherein said auxiliary cutters are arranged radially symmetrically relative to said central shaft.

24. The borer head as defined in claim 23, wherein some of said the auxiliary cutters are positioned at a predetermined radius (23) from an axis of said central shaft, said radius being greater than the greatest distance (A) of the cutters (12) on the cutter discs (10, 11) from the central shaft.

25. The borer head as defined in claim 23, wherein said auxiliary cutters are driven in the direction of rotation counter to that of said cutters on the cutter discs.

26. The borer head as defined in claim 25, further including a supporting device (40, 50, 60, 70, 80) operated to press against a cylindrical wall of a borehole being drilled and including a plurality of supporting elements (41, 54, 59, 74), said supporting device being operatively connected to said central shaft, on the one hand, and to said tool holder, on the other hand, so that said tool holder is driven in a slow rotation about said central shaft.

27. A borer head for drilling boreholes in rock structures, comprising a central shaft; a single drill pipe coupled to the central shaft; at least one tool holder carrying cutters thereon; a planetary gearing operatively connecting said tool holder with said central shaft for driving and rotating said tool holder; and a supporting device operated to press against a cylindrical wall of a borehole being drilled and including a plurality of supporting elements (41, 54, 59, 74) radially symmetrically positioned on the supporting device in respect to said central shaft, said supporting device being operatively connected to said central shaft, on the one hand, and to said tool holder, on the other hand, so that said tool holder is driven to a slow rotation about said central shaft, said supporting elements being hydraulically-operated clamping devices spaced from each other by the same angle and each provided with two piston-cylinder units, one of said piston-cylinder units including a clamping claw abutting against said cylindrical wall, the other of said units being a step-like operating hydraulic device having a longitudinal axis parallel to said central shaft.

* * * * *